US005524897A

United States Patent [19]

Mastronunzio

[11] Patent Number: 5,524,897

[45] Date of Patent: Jun. 11, 1996

[54] STARGAZER GAME, AND METHODS OF CONSTRUCTING AND UTILIZING SAME

[76] Inventor: Joseph Mastronunzio, #60 Rte. 82, Oakdale, Conn. 06370

[21] Appl. No.: 513,471

[22] Filed: Aug. 10, 1995

[51] Int. Cl.[6] ..... A63F 3/00

[52] U.S. Cl. ..... 273/264; 273/236; 273/282.1

[58] Field of Search ..... 273/236, 242, 273/264, 282.1, 283, 271, 157 R

[56] References Cited

U.S. PATENT DOCUMENTS

| | | | |
|---|---|---|---|
| 214,048 | 4/1979 | Macy . | |
| 647,814 | 4/1900 | Dorr . | |
| 1,714,792 | 5/1929 | Kurihara . | |
| 2,239,449 | 4/1941 | Seng | 273/264 X |
| 3,111,320 | 11/1963 | Acosta | 273/264 X |
| 3,820,791 | 6/1974 | Powers . | |
| 3,887,190 | 6/1975 | Ameri . | |
| 4,047,719 | 9/1977 | Sajkovic . | |
| 4,063,736 | 12/1977 | Robinson . | |
| 4,190,256 | 2/1980 | Rudden . | |
| 4,221,387 | 9/1980 | Carter . | |
| 4,254,957 | 3/1981 | Kramer . | |
| 4,463,952 | 8/1984 | Rowbal | 273/236 |
| 4,515,370 | 5/1985 | Garcia . | |
| 4,527,800 | 7/1985 | Samansky . | |
| 4,555,116 | 11/1985 | Fields . | |
| 4,645,209 | 2/1987 | Goulter . | |
| 4,673,185 | 6/1987 | Morley . | |
| 4,739,992 | 4/1988 | May . | |
| 5,344,153 | 9/1994 | Watanabe | 273/271 |

FOREIGN PATENT DOCUMENTS

| | | | |
|---|---|---|---|
| 2023 | 8/1871 | United Kingdom | 273/264 |

*Primary Examiner*—William E. Stoll

*Attorney, Agent, or Firm*—Weiner, Carrier & Burt; William F. Esser; Irving M. Weiner

[57] ABSTRACT

A method of playing a pattern forming game for two or more players. The method comprises the steps of obtaining a hexagonal playing surface divided into a plurality of triangular spaces, the triangular spaces being arranged so as to form a plurality of overlapping star shaped patterns arid a plurality of sets of parallel rows of triangular spaces; obtaining a plurality of triangular game pieces, each of the game pieces being sized so as to substantially cover a triangular space on the playing surface when placed thereover; assigning each player the game pieces of a particular color which is distinct from the color of game pieces assigned to an opponent; determining a sequential playing order to be followed by the players in turn; sequentially performing player turns according to the player order, each player turn comprising the steps of placing at least one of his/her game pieces over a space on the playing surface and replacing an opponent's game piece associated with an adjacent space, with a game piece of the player performing the turn; and calculating each player's game score based upon an extent of coverage of a player's game pieces over each of the star-shaped and row-shaped patterns on the playing surface.

20 Claims, 11 Drawing Sheets

20

21

| SCORING | GAME # | | | | | |
|---|---|---|---|---|---|---|
| | PLAYERS | | | | | |
| | 1 | 2 | 3 | 4 | 5 | 6 |
| # OF PIECES: | | | | | | |
| STARS: #1 | | | | | | |
| #2 | | | | | | |
| #3 | | | | | | |
| #4 | | | | | | |
| #5 | | | | | | |
| #6 | | | | | | |
| #7 | | | | | | |
| N-S ROWS: #1 | | | | | | |
| #2 | | | | | | |
| #3 | | | | | | |
| #4 | | | | | | |
| N-E ROWS: #1 | | | | | | |
| #2 | | | | | | |
| #3 | | | | | | |
| #4 | | | | | | |
| N-W ROWS: #1 | | | | | | |
| #2 | | | | | | |
| #3 | | | | | | |
| #4 | | | | | | |
| TOTALS | | | | | | |

FIG. 14

STARGAZER GAME, AND METHODS OF CONSTRUCTING AND UTILIZING SAME

BACKGROUND OF THE INVENTION

1. Field of Invention

This invention pertains to a game for a plurality of players, and particularly to a game of forming various geometric patterns with a plurality of playing pieces.

2. Description of the Relevant Art

There are known board games. For instance, Macy U.S. Pat. No. 214,048 discloses a pattern-forming game involving a plurality of equilateral triangles.

Dorr U.S. Pat. No. 647,814 discloses a game in which a variety of geometrical designs are created with triangular pieces.

Kurihara U.S. Pat. No. 1,714,792 discloses a board game wherein playing pieces comprising pegs are secured to the game board by being inserted into a hole in the board.

Rudden, Jr. U.S. Pat. No. 4,190,256 discloses a hexagonal game board and a plurality of hexagonally shaped game pieces.

Kramer U.S. Pat. No. 4,254,957 discloses a game involving the creation of geometric forms.

Goulter U.S. Pat. No. 4,654,209 discloses a board game for forming geometric patterns comprised of linear segments, utilizing a game board having a plurality of apertures defined therein for temporarily engaging with a plurality of game pieces.

May U.S. Pat. No. 4,739,992 discloses a board game comprising a hexagonal game board divided into triangular spaces.

Garcia U.S. Pat. No. 4,515,370 discloses a board game involving a triangular game board and a plurality of triangular game pieces.

Samansky U.S. Pat. No. 4,527,800 discloses a foldable board game having triangular and trapezoidal areas thereon.

None of the above-identified references, however, discloses a competitive game of skill involving the creation of geometrical patterns, whose object is to accumulate the most points by occupying the most geometrical patterns on the playing surface through placement of the player's game pieces thereon and replacing other player's adjacent game pieces therewith.

SUMMARY OF THE INVENTION

The present invention overcomes the above-discussed limitations and shortcomings of known board games and satisfies a significant need for a game involving the placement of triangular game pieces on a playing surface in a manner such that a player scores points for positioning her game piece over various geometrical shapes on the playing surface.

According to the present invention, there is provided a playing surface being divided into a plurality of substantially triangular spaces, the spaces defined so as to form overlapping star shaped patterns and sets of parallel rows of triangular spaces; a plurality of game pieces, each being sized and shaped so as to substantially cover a triangular space when placed thereover, and having one of a plurality of colors; a first frame member being shaped so as to substantially define a perimeter of each of the star shaped patterns to assist in identifying the patterns and in calculating a player's score; a second frame member being shaped so as to define each parallel row on the playing surface and to assist in calculating a player's score; and wherein the object of the game is to place game pieces on the playing surface over the triangular spaces and to replace an opponent's game pieces therewith so that the player's game pieces substantially occupy the star shaped patterns and the parallel rows on the playing surface. The playing surface is preferably but not necessarily substantially hexagonal.

In use, the players first determine the sequential playing order to be followed throughout the game, and each player selects a color of game pieces to be assigned thereto. Next, the players take turns placing game pieces over unoccupied triangular spaces on the playing surface, and replacing an opponent's previously placed game piece covering any space adjacent thereto with a playing piece assigned to the player taking the turn. In addition, the player may also remove another's previously placed game piece which covers a space having a corner which touches the corner of the space covered by the immediately placed game piece of the player taking the turn.

When all of the spaces on the playing surface have been covered, the game concludes and points are then awarded to a player for having more playing pieces covering a star-shaped pattern than the other players, for having more playing pieces covering a row of spaces, and for the total number of playing pieces on the playing surface. The player having the most points is declared the winner.

It is an object of the invention to provide a game of skill to be played by a plurality of players, whose object is to define or form geometric patterns on a playing surface while limiting such formation by the other players.

It is another object of the invention to provide a game of skill which is easy to learn and play so that the game may be enjoyed by players of virtually all ages.

Another object of the invention is to provide a game wherein a variety of strategies and scoring systems may be used so as to provide a greater variety of play than provided by existing board games.

A further object of the game is to provide a game that may be played in a wide variety of settings, including when travelling.

Other objects, advantages and salient features of the present invention will become apparent from the following detailed description, which, when taken in conjunction with the annexed drawings, discloses preferred embodiments of the present invention.

BRIEF DESCRIPTION OF THE DRAWINGS

FIG. 14 is a plan view of a score tabulation table according to a preferred embodiment of the present invention.

DETAILED DESCRIPTION OF THE PREFERRED EMBODIMENTS OF THE INVENTION

Figure 1:
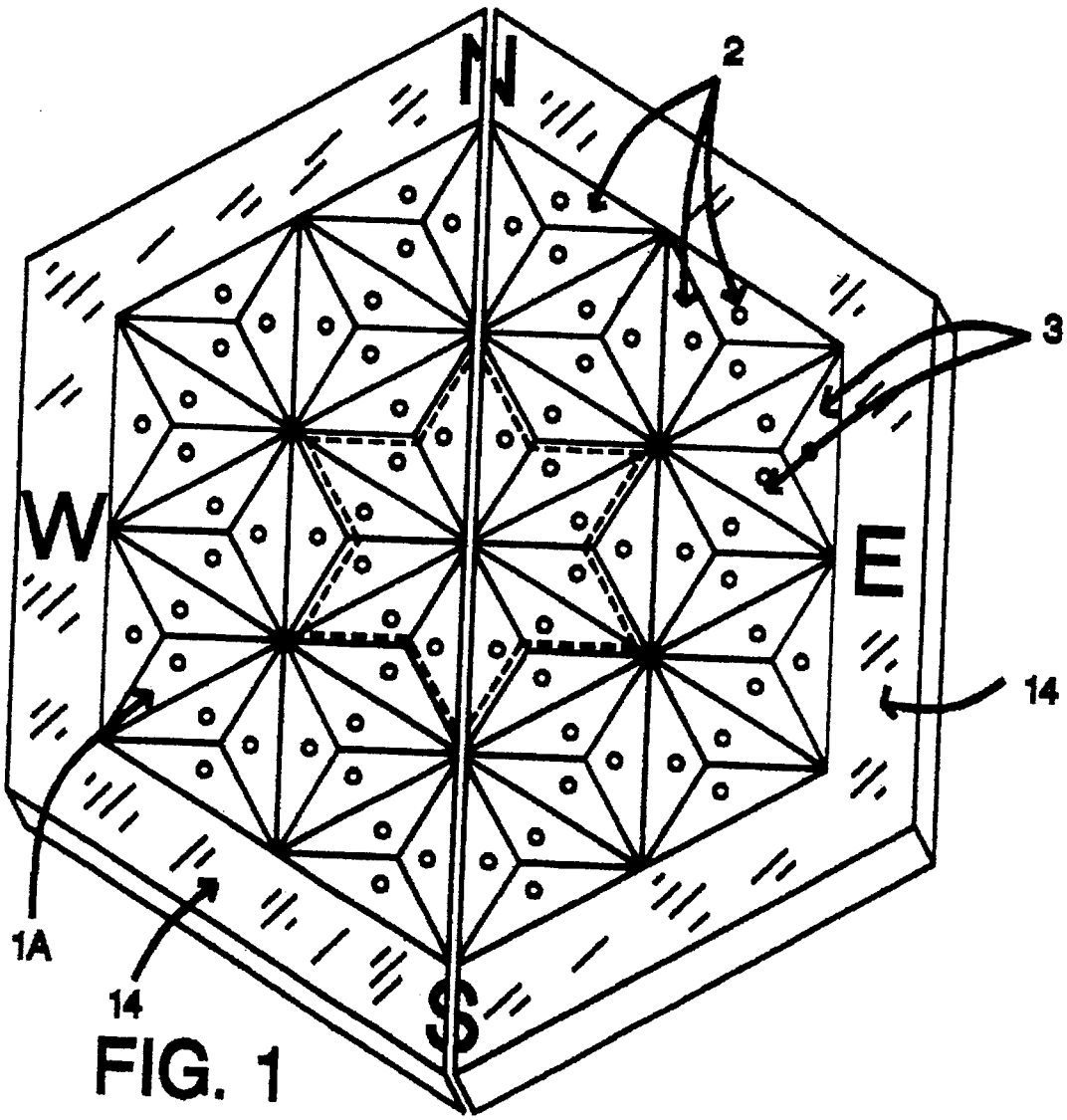
FIG. 1 is a perspective view of the playing surface of a preferred embodiment of the present invention.

Referring to FIGS. 1–5 and 14–15, there is disclosed game board 1, game pieces 5, first frame member 9, second frame member 10, scorecard 20 and carrying case 30. The components are preferably constructed from a substantially rigid and inexpensive material, such as plastic, wood, sheet metal or ceramics, but alternatively they are constructed from other materials.

Game board 1 preferably but not necessarily provides a playing surface 1A on which the game is played. In the preferred embodiments of the present invention, playing surface 1A is divided into a plurality of equally-sized triangular spaces 2, as shown in FIG. 1. Spaces 2 are preferably but not necessarily arranged so as to form seven overlapping star patterns of equal shape, each of which having six points and comprised of twelve triangular spaces 2. The star patterns are preferably organized so that one star pattern is disposed in the center of playing surface 1A (as outlined by the dashed line in FIG. 1) with each of the six other star patterns being disposed along the periphery of playing surface 1A and sharing two triangular spaces 2 therewith. In addition, each of the six peripheral star patterns share two other triangular spaces 2 with adjacent, peripheral star patterns.

Each triangular space 2 is preferably but not necessarily an isosceles triangle. In the preferred embodiments of the present invention, the interior angles opposite the two legs of each triangular space 2 are 30° and the angle opposite the hypotenuse is 120°. In this way, each star-shaped pattern is formed by twelve triangular spaces 2, each space 2 having one 30° corner thereof forming a portion of the star's center and a second 30° corner forming a portion of one of the star's six points. The seven overlapping star patterns are thus formed by 60 triangular spaces 2. Twelve additional triangular spaces 2 preferably but not necessarily substantially border the outer edges of the peripheral star patterns so as that playing surface 1A is substantially hexagonal, as shown in FIG. 1.

Triangular spaces 2, in addition to forming the seven overlapping star patterns, form intersecting sets of parallel rows. As shown in FIG. 1, one set of 4 parallel rows of triangular spaces 2 is disposed in the north-south direction (with reference to the N-S-E-W markings on playing surface 1A); a second set of parallel rows is disposed in the northeast-southwest direction; and the third set of parallel rows of triangular spaces 2 lies in the northwest-southeast direction. Each row preferably possesses a substantially trapezoidal shape.

Game board 1 preferably but not necessarily includes border 14 which substantially surrounds playing surface 1A. Border 14 is preferably raised or elevated relative to playing surface 1A so that game pieces 5 are substantially confined to playing surface 1A when placed thereon.

In a preferred embodiment of the present invention, game board 1 is substantially foldable in half so that the game may be conveniently and effectively stored when not in use. To this end, game board 1 preferably but not necessarily includes at least one hinge member which attaches to each half section thereof.

Figure 2:
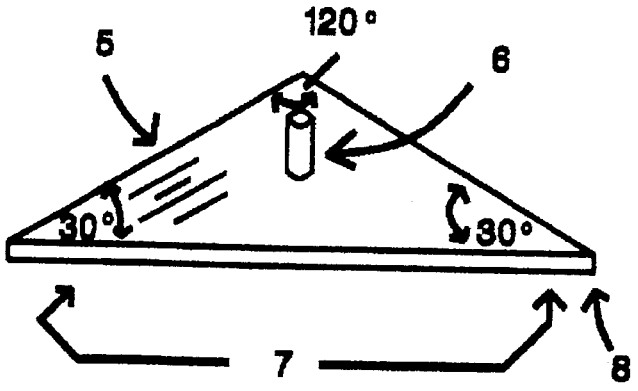
FIG. 2 is a perspective view of a game piece of a preferred embodiment of the present invention.
Figure 3:
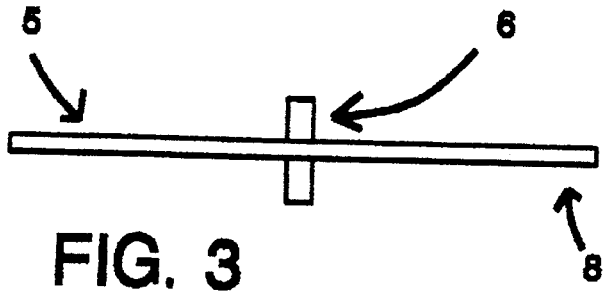
FIG. 3 is a side elevational view thereof.

The preferred embodiments of the present invention preferably include a plurality of triangular game pieces 5. As shown in FIG. 2, each game piece 5 is preferably but not necessarily an isosceles triangle which is sized substantially identically to the triangular spaces 2 of playing surface 1A. In this way, placement of a game piece 5 over a triangular space 2 substantially covers space 2.

Game pieces 5 are preferably but not necessarily grouped according to visual characteristics so that one group thereof can be assigned and identified as corresponding to a particular player. In one preferred embodiment of the present invention, the game pieces 5 are grouped according to color. By way of one example, game pieces 5 are substantially evenly divided into six colors so that players ranging in numbers from two to six may play. The colors of game pieces 5 are preferably but not necessarily chosen so that exciting geometric designs are created when a game is in play. Alternatively, game pieces 5 are grouped by texture, surface etchings, or a combination of color, texture and surface etchings.

The preferred embodiments of the present invention includes a means for placing a game piece 5 over a triangular space 2 of playing surface 1A, and for substantially temporarily securing game piece 5 thereto. In one embodiment, the placement and securement means comprise peg member 6 which preferably extends substantially laterally through a central portion of each game piece 5 (FIG. 2), and an aperture defined within each triangular space 2 (FIG. 1) for receiving an end portion of peg member 6. The opposite end portion of peg member 6 assists a player in gripping the corresponding game piece 5 so that the game piece 5 may be easily placed onto and removed from any triangular space 2.

In an alternative embodiment, the securing means comprises playing surface 1A being constructed from a metal compound, and a portion of game piece 5 being constructed from a magnetic material, so that game piece 5 substantially adheres to the metallic playing surface 1A until it is manually lifted therefrom.

Figure 4:
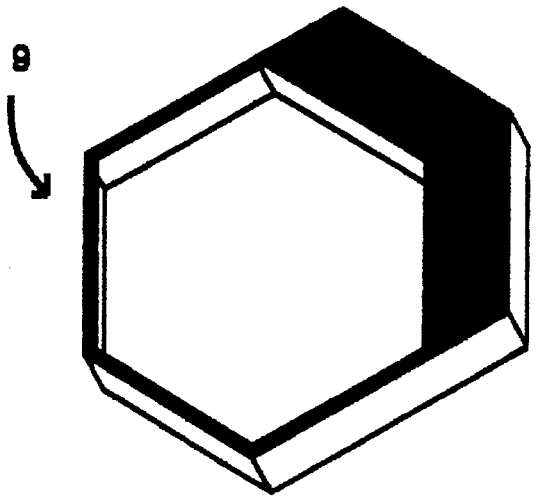
FIG. 4 is a perspective view of a first frame member according to a preferred embodiment of the present invention.
Figure 6:
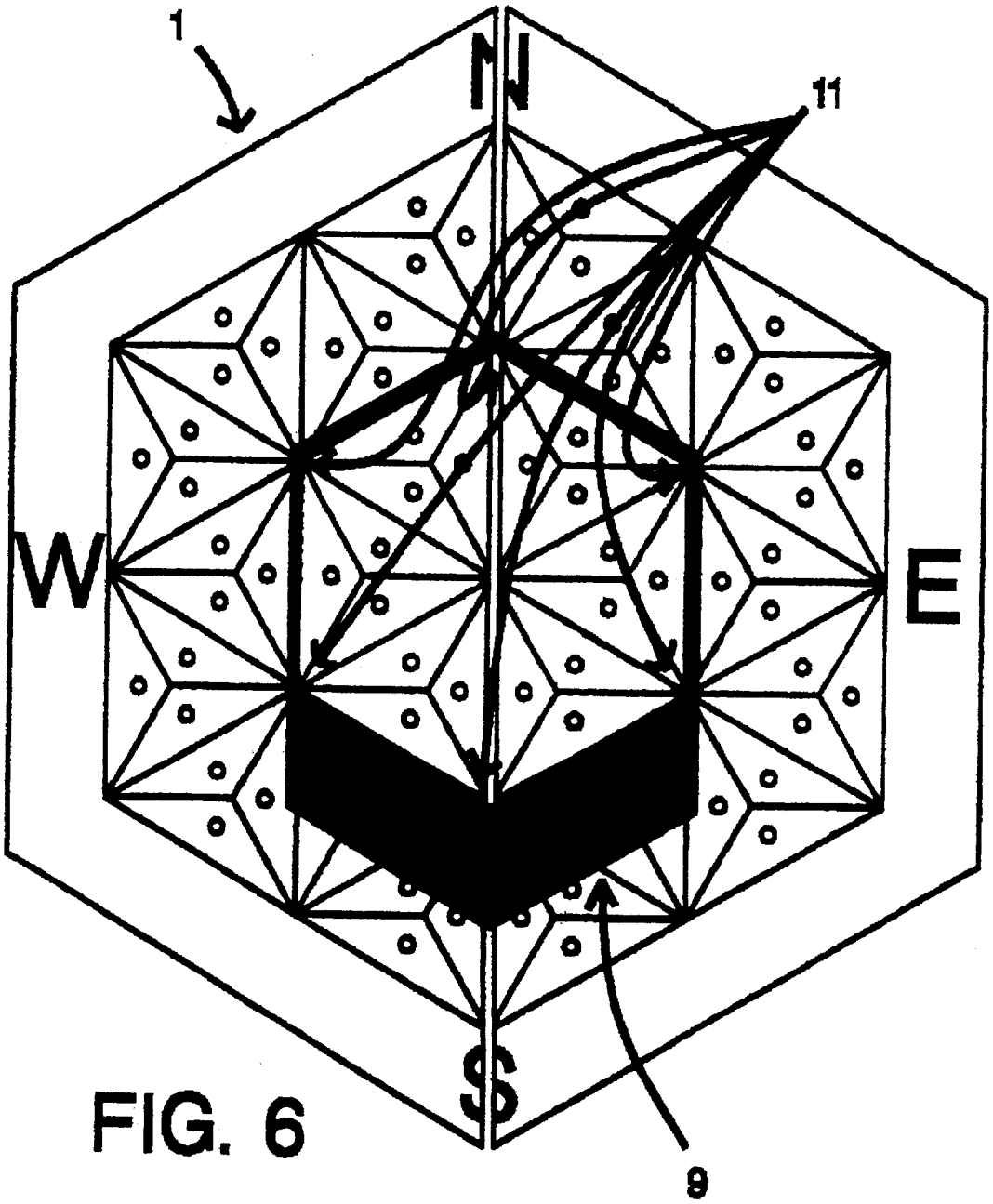
FIGS. 6 and 7 are top plan views of the first frame member in use according to a preferred embodiment of the present invention.
Figure 7:
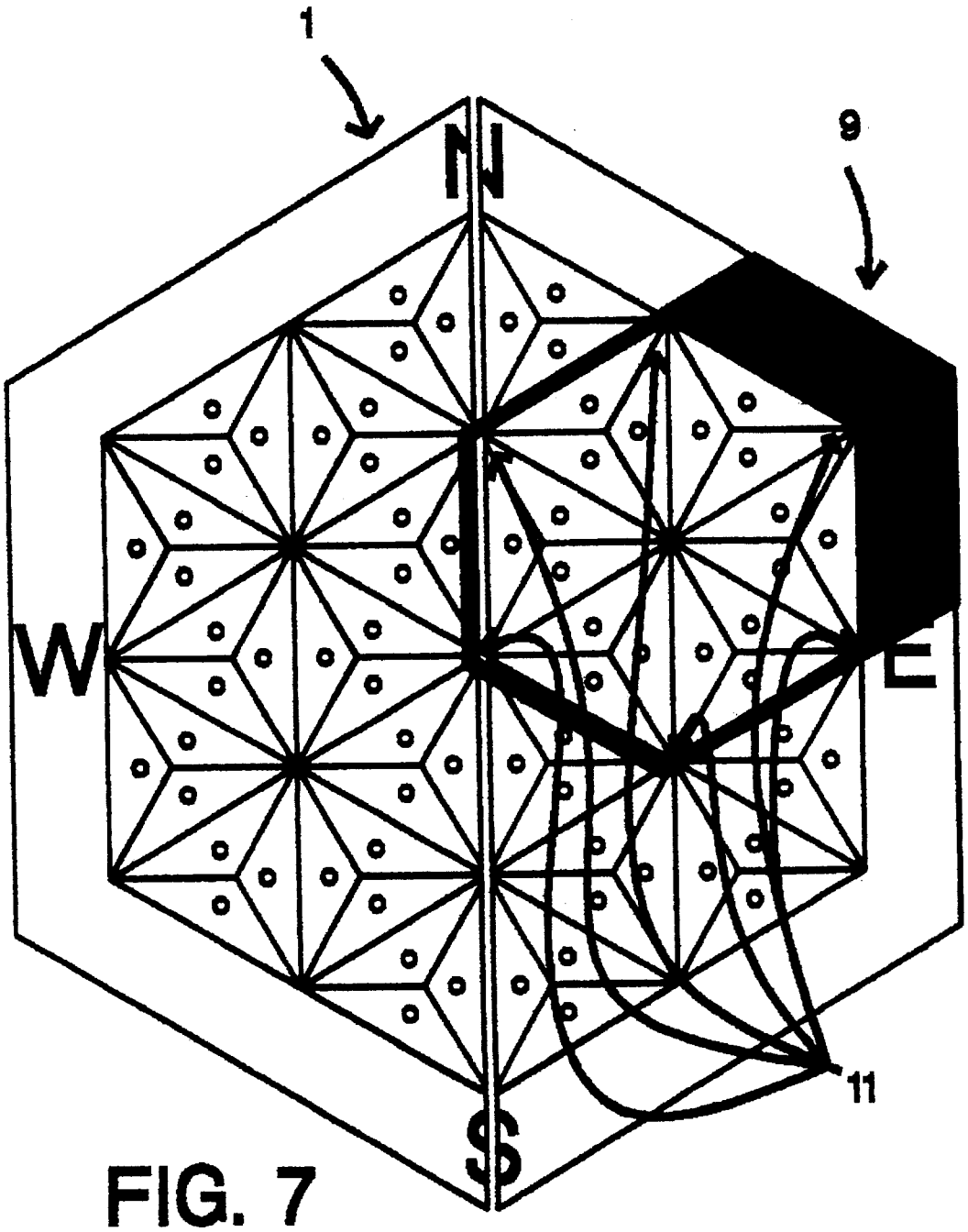

One object of the game according to a preferred embodiment of the present invention is for the players to take turns placing their game pieces 5 on playing surface 1A and removing their opponent's game pieces 5 therefrom so as to substantially occupy each star pattern and row pattern on playing surface I.A, relative to the other players. To facilitate the identification of each star pattern, the present invention preferably includes a first frame member which is adapted for temporary placement over playing surface 1A so as to indicate the perimeter of each star-shaped pattern thereon. Referring to FIG.4, there is shown frame member or "star finder" 9, which is substantially hexagonal in shape. Frame member 9 is adapted for positioning on playing surface 1A either during the course of the game or while calculating each player's score at the conclusion thereof. Frame member 9 can be selectively positioned over the center star pattern and a star pattern located along the periphery of playing surface 1A, as shown in FIGS. 6 and 7, respectively. When positioned over a star pattern, each corner of frame member 9 identifies a point 11 of the star pattern.

Figure 5:
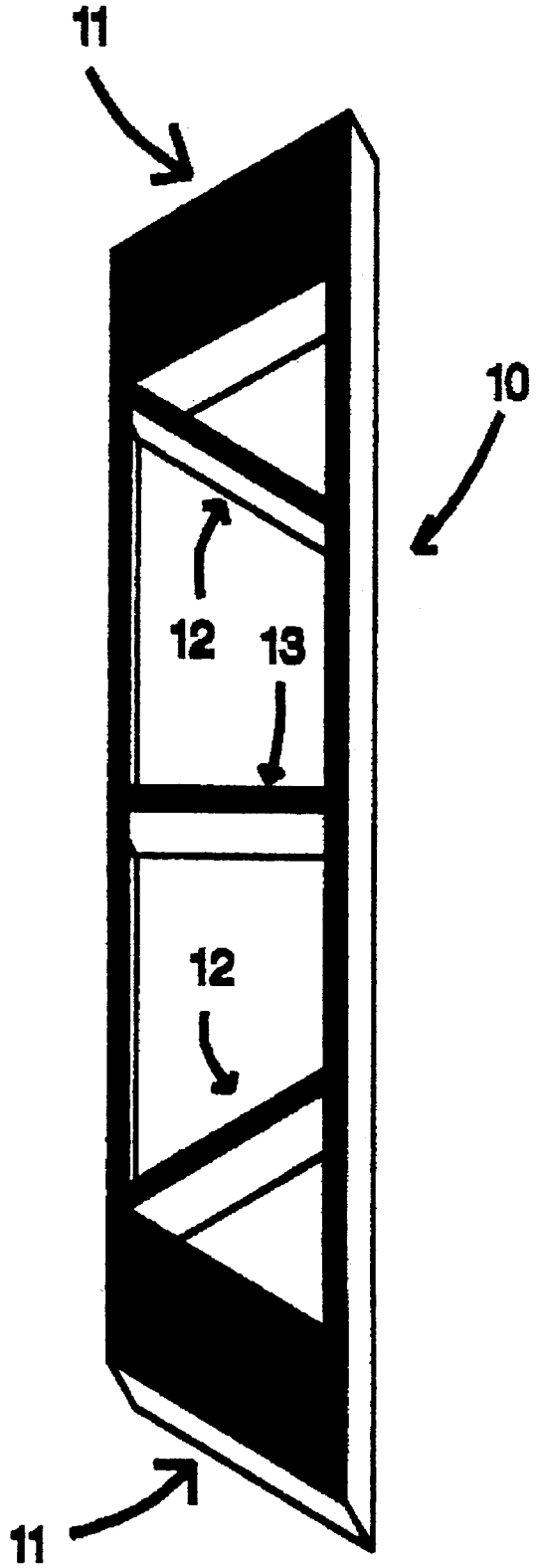
FIG. 5 is a perspective view of a second frame member according to a preferred embodiment of the present invention.

The preferred embodiment of the present invention further includes a second frame member 10 which is used to identify the rows of triangular spaces 2 of playing surface 1A. As shown in FIG. 5, there is shown second frame member or "row finder" 10 which is configured so as to easily indicate to the players the location of each row.

Figure 8:
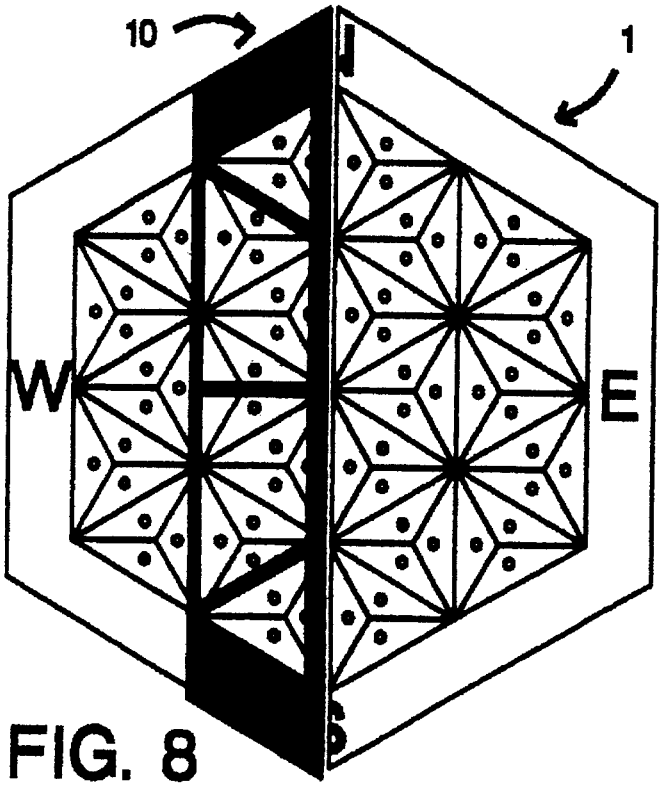
FIGS. 8, 9 and 10 are top plan views of the second frame member in use according to a preferred embodiment of the present invention.
Figure 9:
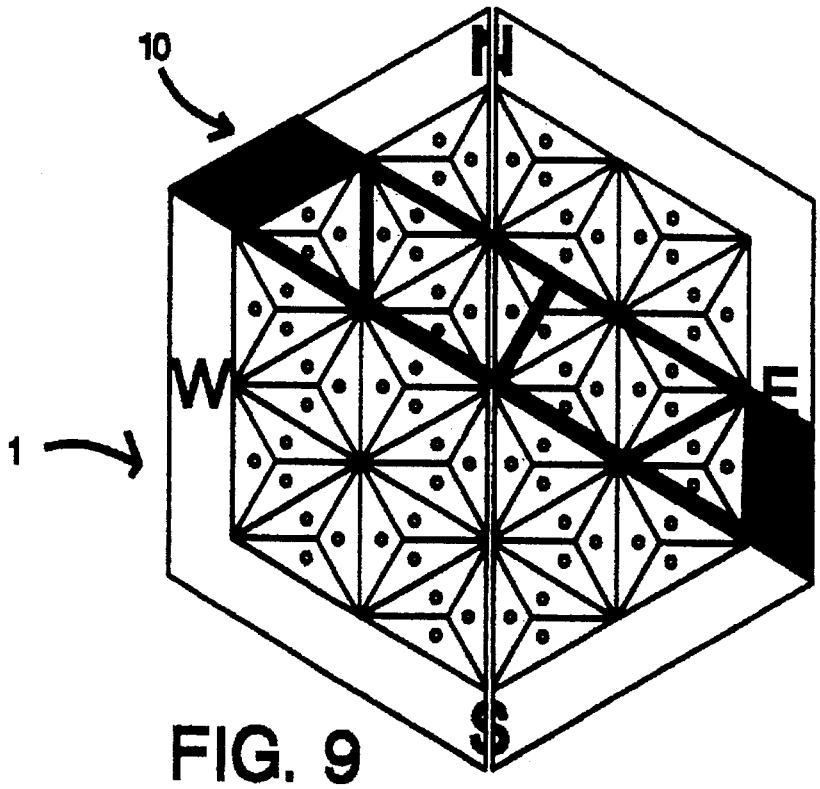
Figure 10:
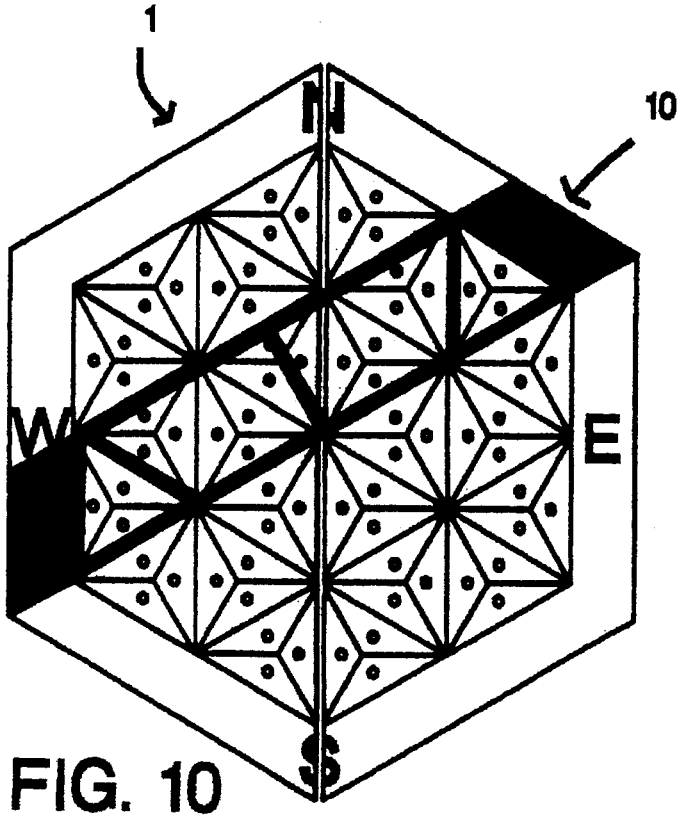

Frame member 10 is preferably but not necessarily shaped as a trapezoid and sized so the perimeter thereof substantially conforms to the perimeter of the six largest rows (the rows passing nearest the center of playing surface 1A). FIGS. 8, 9, and 10 demonstrate the positioning of frame member 10 over playing surface 1A so that the north-south, northwest-southeast, and northeast-southwest rows can be identified, respectively. As with frame member 9, frame member 10 is adapted for selective positioning on playing surface 1A either during the course of the game or while calculating each player's score at the conclusion thereof.

In addition, frame member 10 includes substantially lateral cross bars 12 (FIG. 5) which transverse frame member 10 and form a smaller substantially trapezoidal area so that the smaller trapezoidal area can be utilized to identify the six smaller rows (the outermost rows of triangular spaces 2 on playing surface 1A).

The preferred embodiments of the present invention further include a means for calculating and maintaining each player's game score. Referring to FIG. 14, there is shown scoresheet table 20 for recording each player's score for one game. Scoresheet 20 includes entries for recording each player's awardable of points corresponding to each star pattern and each row, and includes an entry for recording the cumulative score for each player. Directional markings are preferably included on scoresheet 20 so as to correspond to the directions of each set of rows on playing surface 1A, relative to the N-S-E-W indicators on playing surface 1A. In the preferred embodiments of the present invention, scoresheet 20 includes columns for recording player scores for a plurality of games.

Operation of Play

The purpose of the game is to accumulate the most points by "dominating" or having more game pieces in each of the star patterns and row patterns at the end of the game than the game pieces assigned to the other players.

To begin play, the players determine the sequential playing order to be followed by the players in turn. Thereafter, the players take turns executing a move. A player executes a move by placing one of his/her game pieces 5 (an "offensive" piece) on an uncovered triangular space 2 of playing surface 1A and replacing one or more of an opponent's previously placed game piece 5 with another of his/her game pieces 5, depending upon the proximity of the opponent's game piece 5 relative to the immediately placed "offensive" game piece 5 of the player executing the move.

One way in which a player, when executing a move, is allowed to replace one or more opponent's previously placed game piece(s) 5 from playing surface 1A is by placing an "offensive" game piece 5 on a triangular space 2 so that a side thereof is adjacent a side of an opponent's previously placed game piece 5. The player executing the move may replace up to three such previously placed game pieces 5. However, a player executing a move may not replace another player's game piece 5 if the opponent's game piece is the last piece on playing surface 1A.

A second way in which a player, when executing a move, may be allowed to replace one or more opponent's previously placed game piece 5 from playing surface 1A is by placing an "offensive" game piece 5 on a triangular space 2 so that a corner thereof meets a corner of an opponent's previously placed game piece 5. The player executing the move may then replace such previously placed game piece 5. Alternatively, such replacement is allowed only when one of the corners of the "offensive" game piece having a 30° angle meets a 30° corner of an opponent's previously placed game piece. In either case, a player executing a move may not replace an opponent's game piece 5 in this way, if the opponent's game piece at issue is the last of the opponent's game pieces on playing surface 1A. The player executing the move may preferably but not necessarily only replace one of an opponent's previously placed game pieces 5 in this manner.

It is contemplated that the immediately aforementioned type of game piece replacement, called a "point move", is an advanced rule to be used only in games played by experienced players.

Figure 11:
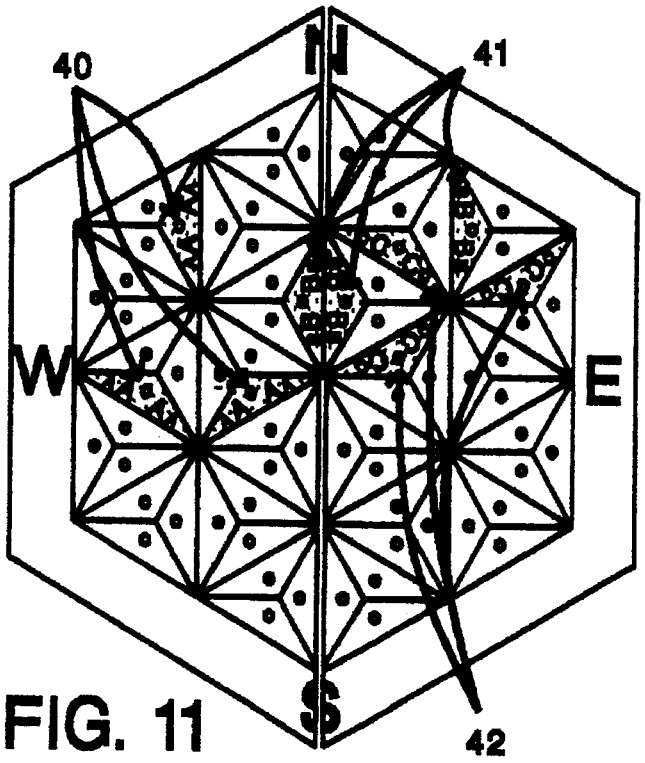
FIGS. 11, 12 and 13 are top plan views of the playing surface of the preferred embodiments of the present invention demonstrating a player move.
Figure 12:
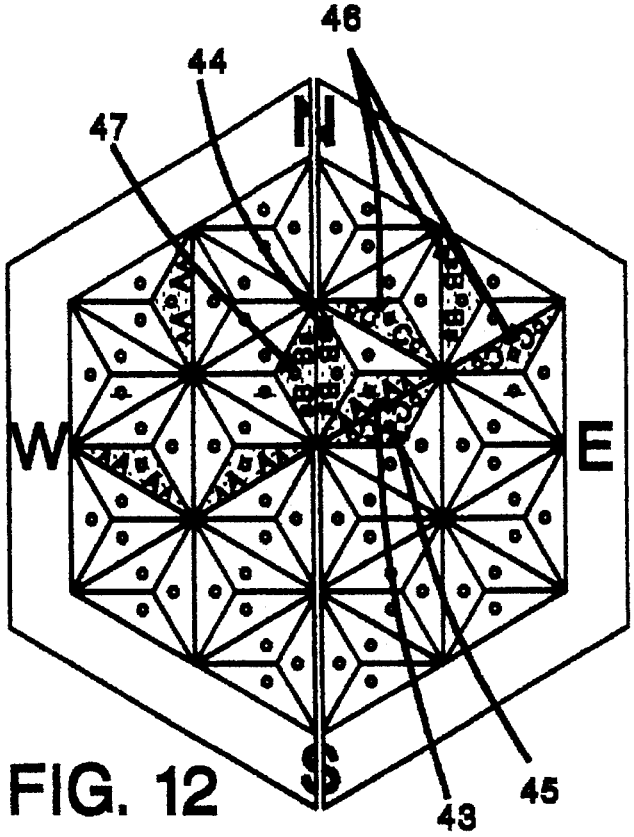
Figure 13:
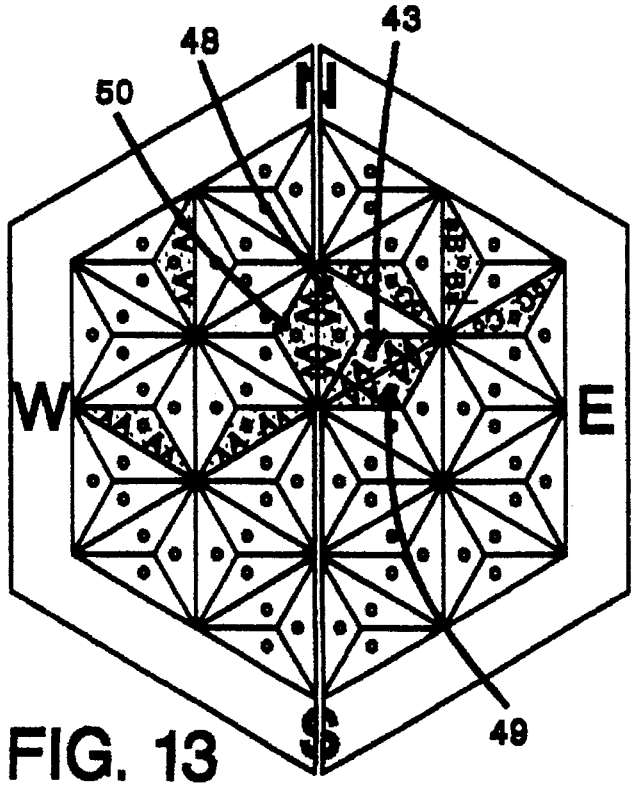

FIGS. 11–13 illustrate the execution of a typical player move. Referring to FIG. 11, there is shown the placement of game pieces 5 corresponding to player A (reference number 40), player B (reference number 41) and player C (reference number 42) prior to player A executing a move.

FIG. 12 shows the placement of "offensive" game piece 43 by player A over a previously uncovered triangular space 2. Game pieces 44 and 45 correspond to previously placed game pieces by players B and C, respectively, each of which has a side which is adjacent a side of "offensive" game piece 43, thus subject to replacement. Game pieces 46 and 47 correspond to previously placed game pieces by players B and C which have a 30° corner that meet a 30° corner of "offensive" game piece 43, thus being eligible for replacement by player A under a "point move".

FIG. 13 shows the effect of player A's executed move. Game piece 43 is the "offensive" game piece placed by player A. Game pieces 48 and 49 are the game pieces of player A which replaced previously placed game pieces of players B and C, respectively, due to the game pieces having sides which were adjacent a side of "offensive" piece 43. Finally, game piece 50 is the game piece of player A as a result of the "point move" thereby, wherein game piece 47 was selected by player A for replacement.

The players preferably but not necessarily take turns executing moves until playing surface 1A has been completely covered by game pieces, at which point the game concludes. Thereafter, each player's score is tabulated in order to determine the winner.

Points are preferably but not necessarily awarded to a player in a variety of ways. First, a player is awarded one point for each game piece 5 remaining on playing surface 1A at the conclusion of the game.

Second, if a player has more game pieces 5 on a star pattern than the game pieces of his/her opponents for that particular star pattern, then the player is awarded a point for each of his/her game pieces 5 on that star pattern. In addition, if a player's game pieces occupy all twelve triangular spaces 2 of a peripherally disposed star pattern, then the player receives two points for each such game piece (i.e., 24 total points). Further, if a player's game pieces occupy all twelve triangular spaces 2 of the centrally disposed star pattern, then the player receives three points for each such game piece thereon (i.e., 36 total points).

Third, if a player has more game pieces 5 on one of the rows of triangular spaces 2, then the player is awarded one point for each of his/her game pieces in that row. If a player's game pieces occupy all of the triangular spaces 2 in a smaller (peripheral) row, then that player is awarded two points for each game piece 5 in that row (i.e., 30 total points). If a player's game pieces 5 occupy all of the triangular pieces in one of the larger (central) rows, then that player is awarded three points for each game piece 5 in that row (i.e., 63 total points).

Frame members 9 and 10 may be utilized during the point calculation phase so that points corresponding to occupancy of the star patterns and row patterns, respectively, may be quickly and easily computed.

It is contemplated that the aforementioned rules of the game can be changed in order to make the game more challenging and/or to add variety thereto. For example, the game may be played in which the player's "offensive" move is limited only to triangular spaces 2 on playing surface 1A that has a corner that meets a corner of a game piece previously placed by that player.

In addition, the game may be played so that the object of the game is to accumulate the lowest point score.

The game may also be played by teams of players, instead of by individual players.

Further, the game may be played wherein the player executing a move is allowed to make more than one "point" moves, such as two "point" moves.

Still further, the rules may be altered so that the game can be enjoyed by children whom are otherwise too young to play or to otherwise fully understand the rules. For instance, the object of the game may be to simply create aesthetically pleasing designs by the players taking turns placing game pieces 5 on playing surface 1A.

Figure 15:
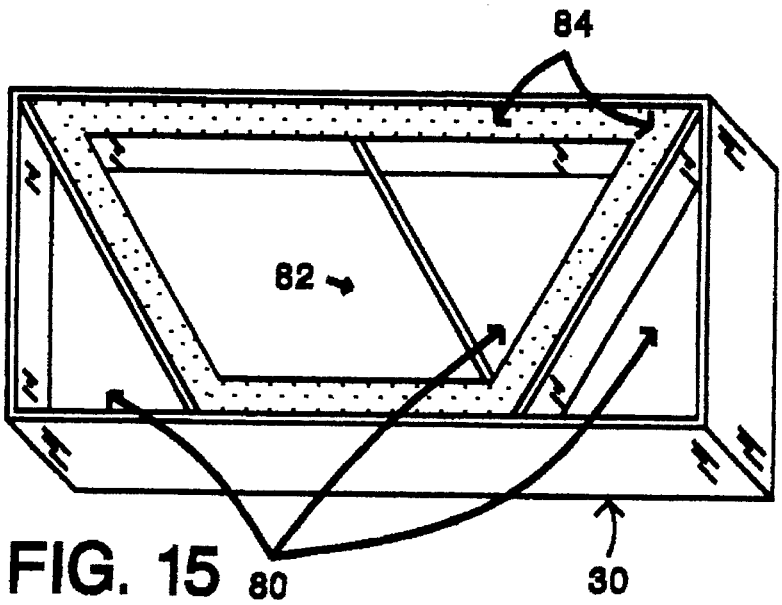
FIG. 15 is a perspective view of a carrying container member of a preferred embodiment of the present invention.

The present invention preferably but not necessarily includes a container for storing game board 1, game pieces 5, frame members 9 and 10, and scoresheet 20. As shown in FIG. 15, container 30 includes dividers for efficiently and securely holding the game components. Compartments 80 are intended to store game pieces 5; compartment 82 is intended to store scoresheet(s) 20; and area 84 is intended to hold folded game board 1.

Although there has been described what are at present considered to be the preferred embodiments of the present invention, it will be understood that the invention can be embodied in other specific forms without departing from the spirit or essential characteristics thereof.

Figure 16:
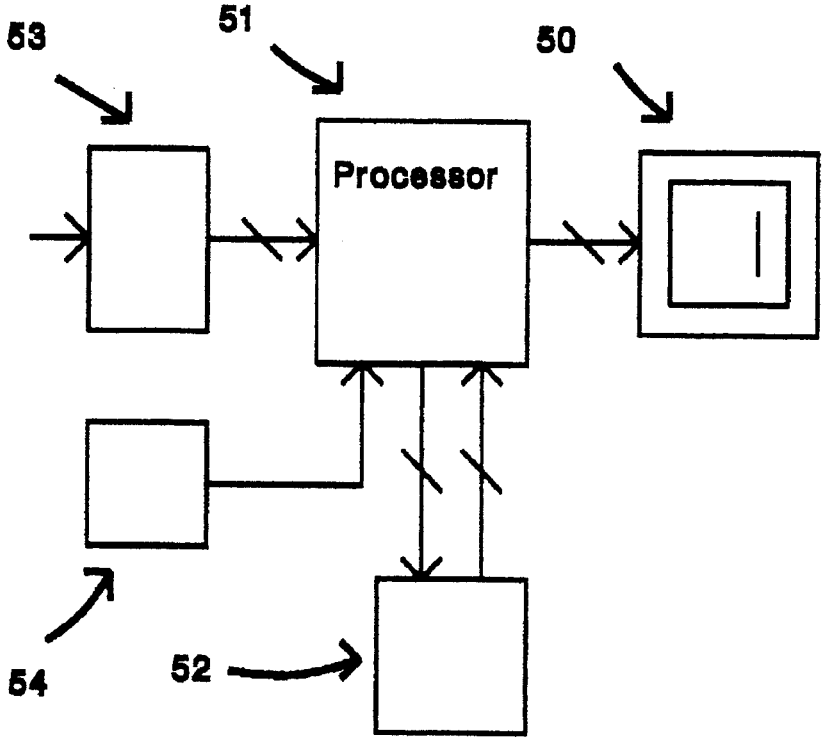
FIG. 16 is a block diagram of an alternative embodiment of the present invention.

For example, the game may be implemented as a video game. Referring to FIG. 16, in this embodiment playing surface 1A is provided as an image on a display screen 50. The alternative embodiment would preferably but not necessarily include a processing unit 51 for receiving user input, controlling the operation of the game and controlling the display on screen 50; memory means 52 for substantially permanently storing the commands for executing the game, maintaining the number and playing order of the players, providing an intermediate game score, temporarily storing the scores of recently played games, etc.; user input means 53 for allowing the players to make the necessary input to processing unit 51 for selecting the desired player moves; and battery 54 for providing power to the device.

User-input means 53 may preferably comprise a keyboard, a joystick, or a combination thereof. To execute a move, a player enters the coordinates corresponding to the desired triangular spaces 2 on which to perform an offensive move as well as a "point" move. Processing unit 51 preferably but not necessarily automatically replaces the opponent's previously placed game pieces having sides adjacent the immediately placed "offensive" game piece.

Figure 17:
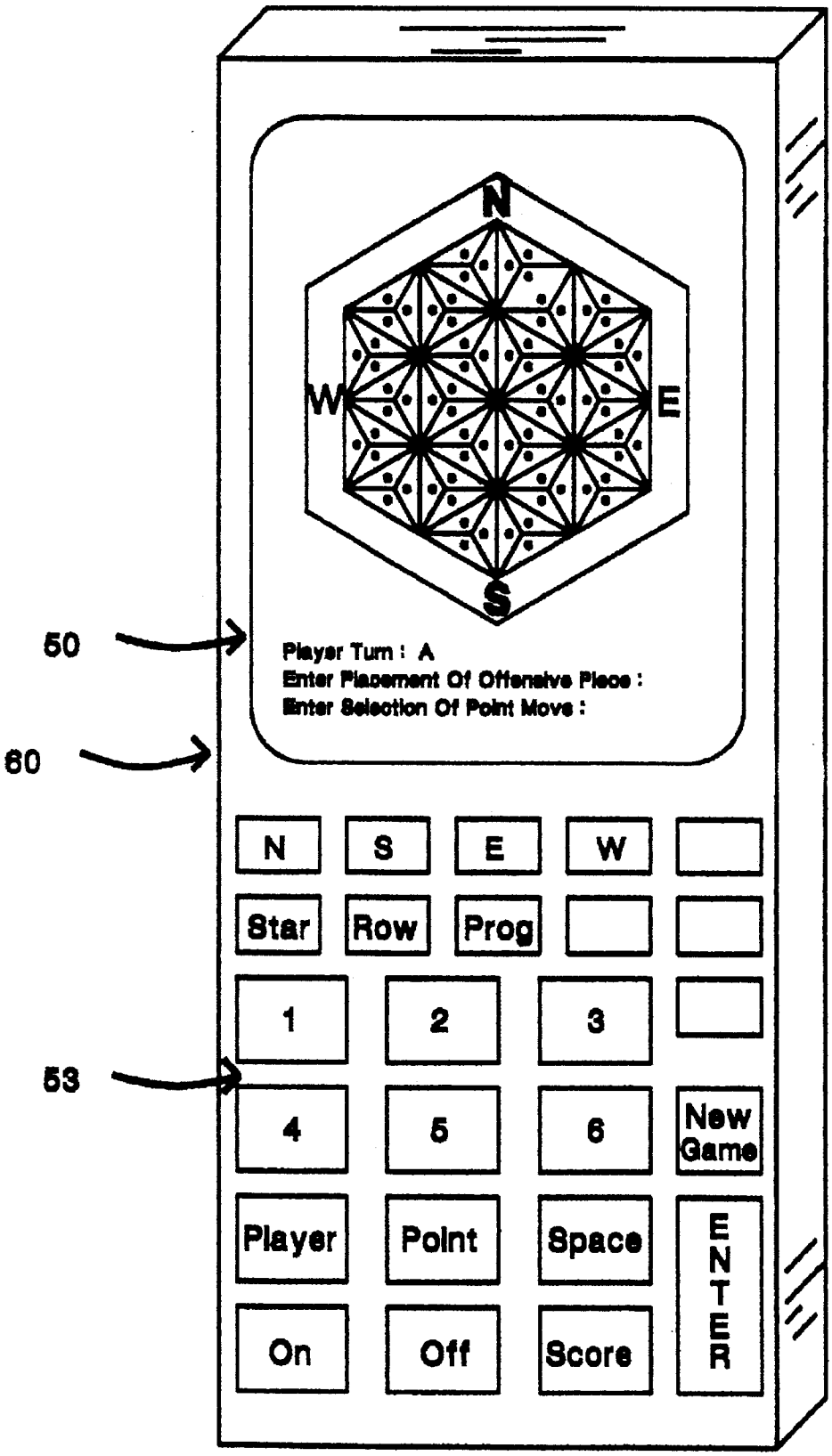
FIG. 17 is a perspective view of the embodiment shown in FIG. 16.

In one alternative embodiment, the game components are placed within a self-contained, hand-held housing 60 so that the game is substantially portable for use in any environment. Referring to FIG. 17, there is shown housing 60, keyboard input means 53, and display screen 50 displaying playing surface 1A. In a second alternative embodiment, the information pertaining to the game is stored in memory means 52 of a video game cartridge so that the game may be played on and/or in conjunction with an existing home video game entertainment system, which itself includes display screen 50, processing unit 51 and user-input means 53.

The described embodiments are, therefore, to be considered in all aspects as illustrative, and not restrictive. The scope of the invention is indicated by the appended claims rather than the foregoing description.

I claim:

1. A method of playing a pattern forming game involving a plurality of players, comprising the steps of:

providing a playing surface being divided into a plurality of substantially polygonal spaces of substantially uniform size and shape, said substantially polygonal spaces forming a plurality of overlapping substantially identical geometric patterns;

providing a plurality of substantially polygonal playing pieces of assorted colors, each of said playing pieces being sized so as to substantially cover one of said substantially polygonal spaces of said playing surface when placed thereover;

assigning each player said playing pieces having a particular color which is different from colors of said playing pieces assigned to other players;

determining a sequential playing order to be followed by the players in turn;

sequentially performing player turns according to said playing order, each player turn comprising the steps of placing at least one playing piece over a space on said playing surface so as to substantially cover said space, and replacing another player's playing piece associated with an adjacent space with a playing piece of the player performing said player turn; and calculating each player's score based upon an extent of coverage of a player's playing pieces over each of said identical geometric patterns on said playing surface.

2. A method as recited in claim 1, wherein:

each of said substantially identical geometric patterns is a star-shaped pattern.

3. A method as recited in claim 2, wherein:

said calculating step includes the steps of obtaining a frame member which is substantially sized and shaped to a perimeter of each of said star-shaped patterns, and sequentially placing said frame member over said star-shaped patterns of said playing surface so as to assist in determining said extent of coverage.

4. A method as recited in claim 2, wherein:

said score calculating step comprises the steps of determining the player having the most of said playing pieces covering a star shaped pattern, awarding a point to said player for each of said playing pieces covering said star shaped pattern, and repeating said determining step and said point awarding step for each of said star-shaped patterns.

5. A method as recited in claim 1, wherein:

said polygonal playing surface spaces form parallel rows of said playing surface spaces; and said score calculating step is also based upon an extent of coverage of a player's playing pieces over each of said rows.

6. A method as recited in claim 5, wherein:

said calculating step includes the steps of obtaining a frame member which is substantially sized and shaped to a perimeter of said parallel rows of said playing surface spaces, and sequentially placing said frame member over each of said rows so as to assist in identifying each row and in determining said extent of coverage thereof.

7. A method as recited in claim 5, wherein:

said playing surface forms approximately three sets of four parallel rows.

8. A method as recited in claim 5, wherein:

said score calculating step includes the steps of determining the player having the most of said playing pieces covering a row of said polygonal spaces, awarding a point to said player for each of said playing pieces covering said row of said spaces, and repeating said determining step and said point awarding step for each of said rows of said spaces.

9. A method as recited in claim 1, wherein:

said step of performing a player's turn further includes the step of replacing another player's previously placed playing piece if said previously placed playing piece has a corner which is substantially proximal to a corner of said playing piece immediately placed by the player performing said player turn.

10. A method as recited in claim 1, wherein:

said scoring step is performed when substantially all of said spaces of said playing surface have been covered by playing pieces.

11. A method as recited in claim 1, wherein:

said player turn performing step comprises the step of replacing all other player's pieces covering an adjacent space with a playing piece of the player performing said player turn.

12. A method as recited in claim 1, wherein: each of said playing pieces is substantially shaped as a triangle; and each of said polygonal spaces is substantially shaped as a triangle.

13. A method as recited in claim 1, wherein:

said playing surface providing step and said playing piece providing step comprise the steps of:

obtaining a display screen, a processing unit for controlling operation of said game, memory means for storing data related to said game operation, and user input means for providing data by the players to said processing unit related to said player turn performing step; and projecting images of said playing surface and said playing pieces on said display screen as controlled by said processing unit and said user input means.

14. A pattern forming game apparatus for use by a plurality of players, comprising:

a playing surface being divided into a plurality of substantially triangular spaces;

a plurality of game pieces, each of said game pieces being substantially triangular and having one of a plurality of colors;

said substantially triangular spaces and said game pieces are of substantially equal size;

said substantially triangular spaces are defined so as to form a plurality of overlapping star-shaped patterns of substantially identical shape;

said substantially triangular spaces and said game pieces are isosceles triangles;

each of said game pieces includes a peg member defined substantially through a central portion thereof; and each said space on said playing surface includes an aperture defined within a central portion for temporary engagement with a peg member of a game piece when said game piece is placed over said space.

15. A game apparatus as recited in claim 14, wherein:

said substantially triangular spaces form a plurality of overlapping patterns, each of said patterns having a substantially star shape and having six points; and each of said star-shaped patterns is formed by twelve substantially triangular spaces.

16. A game apparatus as recited in claim 15, further including:

a first frame member having a substantially hexagonal shape, for temporary placement over each of said star shaped patterns so as to define a perimeter of each of said pattern.

17. A game apparatus as recited in claim 14, wherein:

said substantially triangular spaces form a plurality of sets of parallel rows.

18. A game apparatus as recited in claim 17, further including:

a second frame member having a substantially polygonal shape sized so as to substantially define a perimeter of each of said rows when placed thereover.

19. A kit for playing a game involving a plurality of players, comprising:

a substantially planar playing surface being divided into a plurality of substantially equally sized spaces, said spaces forming overlapping patterns having substantially star shapes;

a plurality of playing pieces, each of said playing pieces being shaped and sized to substantially cover one of said spaces when placed thereover;

each of said playing pieces having one of a plurality of colors, with each player being assigned to said playing pieces corresponding to one of said colors;

means for temporarily securing said playing pieces over said spaces of said playing surface; and a scoring means for recording each player's game score, each player's game score being based upon an extent of said playing pieces assigned to said player which cover said star-shaped patterns.

20. A kit as recited in claim 19, wherein:

each of said playing pieces includes a peg member defined laterally therethrough; and each of said spaces of said playing surface includes an aperture defined therein for receiving an end portion of said peg member from one of said playing pieces so as to substantially temporarily secure said playing piece over said space.

* * * * *